US012435492B2

(12) United States Patent
Horii et al.

(10) Patent No.: US 12,435,492 B2
(45) Date of Patent: Oct. 7, 2025

(54) HYDRAULIC SYSTEM OF WORKING MACHINE AND WORKING MACHINE

(71) Applicant: KUBOTA CORPORATION, Osaka (JP)

(72) Inventors: Hiroshi Horii, Osaka (JP); Hiroya Mori, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 18/741,261

(22) Filed: Jun. 12, 2024

(65) Prior Publication Data

US 2024/0328122 A1 Oct. 3, 2024

Related U.S. Application Data

(63) Continuation of application No. PCT/JP2022/045018, filed on Dec. 7, 2022.

(30) Foreign Application Priority Data

Jan. 5, 2022 (JP) ..... 2022-000604

(51) Int. Cl.
*E02F 9/22* (2006.01)

(52) U.S. Cl.
CPC ..... *E02F 9/2285* (2013.01); *E02F 9/2228* (2013.01)

(58) Field of Classification Search
CPC ..... F15B 21/045; E02F 9/2285; E02F 9/2228; E02F 9/20
See application file for complete search history.

(56) References Cited

U.S. PATENT DOCUMENTS 5,667,051 A * 9/1997 Goldberg ..... F02C 7/32 60/329
7,287,374 B2 * 10/2007 Vigholm ..... F15B 21/0427 60/329

(Continued)

FOREIGN PATENT DOCUMENTS

JP 5-79503 A 3/1993
JP 2009-509837 A 3/2009
JP 2018-188825 A 11/2018

OTHER PUBLICATIONS

International Search Report dated Jan. 31, 2023 in WIPO Patent Application No. PCT/JP2022/045018 and English language translation thereof.

(Continued)

*Primary Examiner* — Thomas E Lazo
(74) *Attorney, Agent, or Firm* — GREENBLUM & BERNSTEIN, P.L.C.

(57) ABSTRACT

A hydraulic system of a working machine includes: a hydraulic actuator; a direction switching valve; the solenoid proportional valve; a controller to control a current to be supplied to the solenoid proportional valve; an operation member for a worker to operate the hydraulic actuator; and a permission operation actuator capable of performing a switching operation between a permission operation for permitting driving of the hydraulic actuator and a non-permission operation for not permitting the driving, in which, when the permission operation actuator is subjected to the non-permission operation and a temperature of the hydraulic fluid is lower than a predetermined temperature, the controller supplies, to the solenoid proportional valve, a first standby current of a first current value defined in a range in which a switching position of the direction switching valve is not switched.

15 Claims, 6 Drawing Sheets

(56) References Cited

U.S. PATENT DOCUMENTS

| | | | | |
|---|---|---|---|---|
| 8,240,781 | B2 * | 8/2012 | Heckmann | B60T 8/90 303/191 |
| 2009/0051215 | A1 | 2/2009 | Heckmann et al. | |
| 2013/0312402 | A1 * | 11/2013 | Horii | E02F 9/2296 60/459 |
| 2021/0207345 | A1 * | 7/2021 | Kobayashi | F15B 11/028 |

OTHER PUBLICATIONS

Written Opinion dated Jan. 31, 2023 in WIPO Patent Application No. PCT/JP2022/045018 and English language translation thereof.

* cited by examiner

HYDRAULIC SYSTEM OF WORKING MACHINE AND WORKING MACHINE

CROSS REFERENCE TO RELATED APPLICATIONS

This application is a continuation application of International Application No. PCT/JP2022/045018, filed on Dec. 7, 2022, which claims the benefit of priority to Japanese Patent Application No. 2022-000604, filed on Jan. 5, 2022. The entire contents of each of these applications are hereby incorporated herein by reference.

BACKGROUND OF THE INVENTION

1. Field of the Invention

The present invention relates to a hydraulic system of a working machine and a working machine.

2. Description of the Related Art

In the related art, a working machine disclosed in Japanese Unexamined Patent Application Publication No. 2018-188825 is known.

A working machine disclosed in Japanese Unexamined Patent Application Publication No. 2018-188825 includes a hydraulic actuator operated by a hydraulic fluid, an electromagnetic control valve that controls a flow rate of the hydraulic fluid flowing to the hydraulic actuator, an operation member that receives an operation of an operator (worker) to the hydraulic actuator, and a controller that controls an opening of the electromagnetic control valve in accordance with an operation amount of the operation member. The electromagnetic control valve is an electromagnetic three-position switching valve in which a position of a spool is switched by the hydraulic fluid (pilot fluid).

SUMMARY OF THE INVENTION

In the working machine of Japanese Unexamined Patent Application Publication No. 2018-188825, the controller can operate the hydraulic actuator by controlling the opening of the electromagnetic control valve in accordance with the operation amount of the operation member.

However, under a low temperature condition in a cold district or the like, the fluid temperature of the hydraulic fluid becomes low and the viscous resistance of the hydraulic fluid increases, which causes a response delay.

The present invention has been made to solve such a problem of the related art, and an object of the present invention is to prevent or reduce a decrease in response speed of a solenoid proportional valve at a low temperature.

A hydraulic system of a working machine according to an aspect of the present invention includes: a hydraulic actuator to be driven by a hydraulic fluid; a direction switching valve to change a flow rate of the hydraulic fluid to be supplied to the hydraulic actuator to control an operation of the hydraulic actuator; a solenoid proportional valve to control a switching position of the direction switching valve by a solenoid being energized in accordance with a supplied current; a controller to control a current to be supplied to the solenoid proportional valve; an operation member for a worker to operate the hydraulic actuator; and a permission operation actuator capable of performing a switching operation between a permission operation for permitting driving of the hydraulic actuator and a non-permission operation for not permitting the driving, in which, when the permission operation actuator is subjected to the non-permission operation and a temperature of the hydraulic fluid is lower than a predetermined temperature, the controller supplies, to the solenoid proportional valve, a first standby current of a first current value defined in a range in which the switching position of the direction switching valve is not switched.

When the temperature of the hydraulic fluid is higher than or equal to the predetermined temperature, the controller may supply a second standby current of a second current value lower than the first current value to the solenoid proportional valve corresponding to the hydraulic actuator not operated by the operation member.

When the permission operation actuator is subjected to the permission operation and the temperature of the hydraulic fluid is lower than the predetermined temperature, the controller may supply the first standby current or a second standby current of a second current value lower than the first current value to the solenoid proportional valve corresponding to the hydraulic actuator not operated by the operation member.

When the permission operation actuator is subjected to the permission operation and the temperature of the hydraulic fluid is lower than the predetermined temperature, the controller may cause the first standby current to flow through the solenoid proportional valve corresponding to the hydraulic actuator not operated by the operation member, and, when the permission operation actuator is subjected to the permission operation and the temperature of the hydraulic fluid is higher than or equal to the predetermined temperature, the controller may cause the second standby current to flow through the solenoid proportional valve corresponding to the hydraulic actuator not operated by the operation member.

When the permission operation actuator is subjected to the non-permission operation and the temperature of the hydraulic fluid is higher than or equal to the predetermined temperature, the controller may not supply a current to the solenoid proportional valve.

The controller may supply a dither current obtained by adding a vibration component to the first current value to the solenoid proportional valve as the first standby current.

The hydraulic system of a working machine may include: a hydraulic fluid tank to store the hydraulic fluid; a hydraulic pump to suck and deliver the hydraulic fluid in the hydraulic fluid tank; a supply fluid passage connected to the hydraulic pump; a hydraulic fluid passage connected to the supply fluid passage and the solenoid proportional valve to supply the hydraulic fluid from the supply fluid passage to the solenoid proportional valve; and a warm-up fluid passage to circulate the hydraulic fluid delivered by the hydraulic pump to the hydraulic fluid tank via the hydraulic fluid passage when the permission operation actuator is subjected to the non-permission operation.

The hydraulic system of a working machine may include an unloading valve to be switched to a supply position in which the hydraulic fluid in the supply fluid passage is supplied to the hydraulic fluid passage when the permission operation actuator is subjected to the permission operation, and to be switched to a suppression position in which supply of the hydraulic fluid to the hydraulic fluid passage is suppressed when the permission operation actuator is subjected to the non-permission operation, in which the warm-up fluid passage may connect the supply fluid passage and the hydraulic fluid passage in parallel to the unloading valve.

The permission operation actuator may be a lever lock capable of performing the permission operation and the non-permission operation by being subjected to a swing operation.

A working machine may include the hydraulic system.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

DETAILED DESCRIPTION OF THE EXAMPLE EMBODIMENTS

Figure 1:
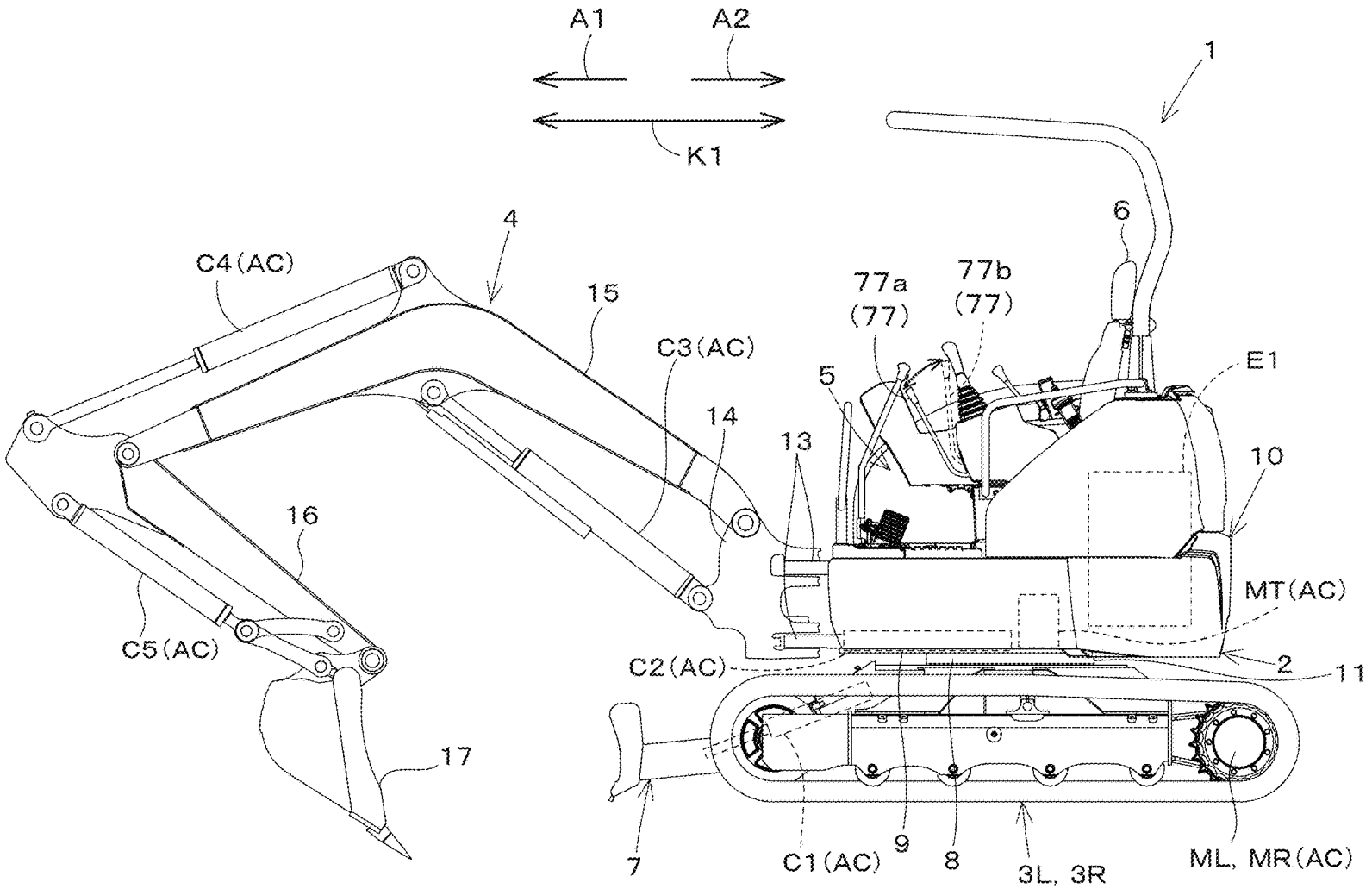
FIG. 1 is a side view of a working machine.

Example embodiments will now be described with reference to the accompanying drawings, wherein like reference numerals designate corresponding or identical elements throughout the various drawings. The drawings are to be viewed in an orientation in which the reference numerals are viewed correctly.

An embodiment of the present invention will be described below with reference to the drawings as necessary.

First Embodiment

FIG. 1 is a side view illustrating an overall configuration of a working machine 1. In the present embodiment, a backhoe, which is a slewable working machine, is exemplified as the working machine 1.

As illustrated in FIG. 1, the working machine 1 includes a machine body (slewing base) 2, a left traveling device 3L disposed on the left of the machine body 2, a right traveling device 3R disposed on the right of the machine body 2, and a working device 4 attached to a front portion of the machine body 2. An operator's seat 6 on which a worker (operator) sits is provided on the machine body 2.

In the present embodiment, a direction in which the worker seated on the operator's seat 6 of the working machine 1 faces (a direction of an arrow A1 in FIG. 1) is referred to as a forward direction, and its opposite direction (a direction of an arrow A2 in FIG. 1) is referred to as a rearward direction. In addition, the left of the worker (the near side in FIG. 1) is referred to as left, and the right of the worker (the far side in FIG. 1) is referred to as right. Therefore, a direction K1 in FIG. 1 is a front-rear direction (machine-body front-rear direction). In addition, a horizontal direction orthogonal to the front-rear direction K1 is referred to as a machine-body widthwise direction.

In the present embodiment, the left traveling device 3L and the right traveling device 3R are crawler type traveling devices. The left traveling device 3L is driven by a traveling motor ML, and the right traveling device 3R is driven by a traveling motor MR. Each of the traveling motors ML and MR is constituted by a hydraulic motor (hydraulic actuator AC). A dozer device 7 is mounted on a front portion of a traveling frame 11 on which the left traveling device 3L and the right traveling device 3R are mounted. The dozer device 7 can be raised and lowered (the blade can be raised and lowered) by extending and contracting a dozer cylinder C1.

The machine body 2 is supported on the traveling frame 11 via a slewing bearing 8 so as to be slewable about a vertical axis (an axis extending in the vertical direction). The machine body 2 is driven to slew by a slewing motor MT including a hydraulic motor (hydraulic actuator AC).

The machine body 2 includes a slewing board 9 that slews about a vertical axis, and a weight 10 supported on a rear portion of the slewing board 9. The slewing board 9 is formed of a steel plate or the like, and is connected to the slewing bearing 8. A prime mover E1 is mounted on a rear portion of the machine body 2. The prime mover E1 is an engine. Note that the prime mover E1 may be an electric motor or may be of a hybrid type having an engine and an electric motor.

The machine body 2 has a support bracket 13 at its front portion. A swing bracket 14 is attached to the support bracket 13 so as to be swingable about a vertical axis. The working device 4 is attached to the swing bracket 14.

The working device 4 includes a boom 15, an arm 16, and a bucket 17 as a working tool. A base portion of the boom 15 is pivotally attached to the swing bracket 14 so as to be rotatable about a horizontal axis (an axis extending in the machine-body widthwise direction), and the boom 15 is swingable in the vertical direction. A base portion of the arm 16 is pivotally attached to the distal end of the boom 15 so as to be rotatable about a horizontal axis, and the arm 16 is swingable in the front-rear direction K1 or the vertical direction. The bucket 17 is provided on the distal end of the arm 16 so as to be capable of performing a shoveling operation and a dumping operation. Instead of or in addition to the bucket 17, another working tool (hydraulic attachment) that can be driven by the hydraulic actuator AC can be attached to the working machine 1.

The swing bracket 14 is swingable by expansion and contraction of a swing cylinder C2 provided in the machine body 2. The boom 15 is swingable by expansion and contraction of a boom cylinder C3. The arm 16 is swingable by expansion and contraction of an arm cylinder C4. The bucket 17 can perform a shoveling operation and a dumping operation by expansion and contraction of a bucket cylinder C5 as a working tool cylinder. The dozer cylinder C1, the swing cylinder C2, the boom cylinder C3, the arm cylinder C4, and the bucket cylinder C5 are constituted by hydraulic cylinders (hydraulic actuators AC).

Figure 2:
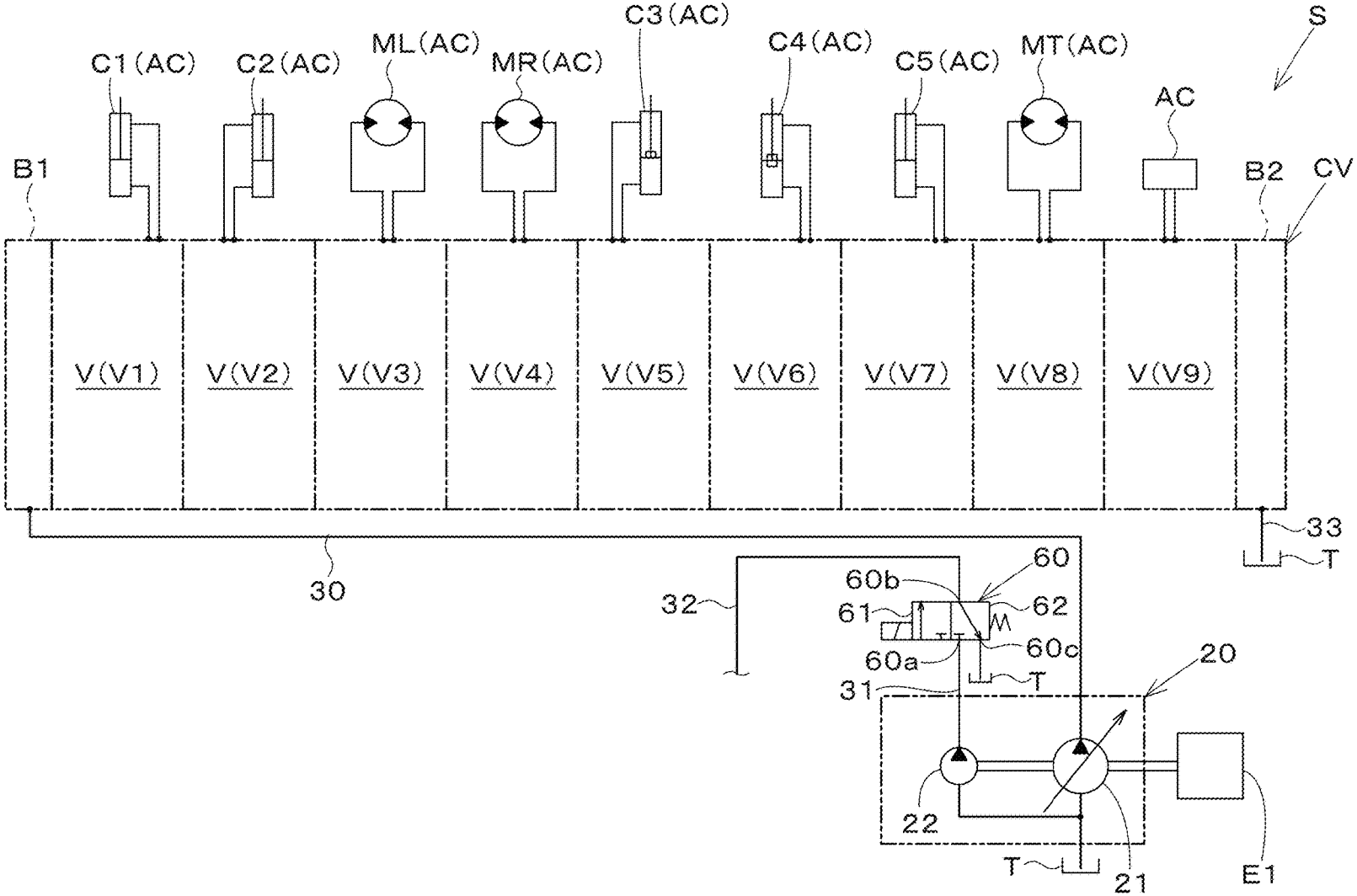
FIG. 2 is a schematic diagram of a hydraulic system of the working machine for driving various hydraulic actuators in a first embodiment.

FIG. 2 illustrates a schematic configuration of a hydraulic system S of the working machine 1 for operating the various hydraulic actuators AC (MT, ML, MR, and C1 to C5) described above (mounted on the working machine 1). As illustrated in FIG. 2, the hydraulic system S of the working machine 1 includes a pressure fluid supply unit 20 and a control valve CV.

The pressure fluid supply unit 20 is equipped with a first pump (main pump) 21 for supplying a hydraulic fluid for operating the hydraulic actuators AC and a second pump (pilot pump) 22 for supplying a pilot pressure and a signal pressure of a detection signal or the like. The first pump 21 and the second pump 22 are driven by the prime mover E1, and suck and deliver the hydraulic fluid in a hydraulic fluid tank T. The first pump 21 is constituted by a variable displacement hydraulic pump (swash-plate variable displacement axial pump) capable of changing a delivery amount by changing the angle of a swash plate. The second pump 22 is constituted by a fixed-displacement gear pump. In the following description, the second pump 22 may be referred to as a "hydraulic pump".

The control valve CV is configured such that a plurality of control valves V (V1 to V9) for controlling the various hydraulic actuators AC (MT, ML, MR, and C1 to C5) driven by the hydraulic fluid, an inlet block B1, and an outlet block B2 are arranged (stacked) in one direction, are coupled to each other, and are connected to each other by internal fluid passages.

As illustrated in FIG. 2, the hydraulic system S of the working machine 1 includes a delivery fluid passage 30 and a supply fluid passage 31. The delivery fluid passage 30 is a fluid passage that connects the first pump 21 and the inlet block B1. Therefore, the fluid delivered from the first pump 21 is supplied to the inlet block B1 via the delivery fluid passage 30, and is then supplied to each of the control valves V (V1 to V9).

The supply fluid passage 31 is a fluid passage connected to the second pump 22, and is a fluid passage through which the hydraulic fluid (delivery fluid) delivered from the second pump 22 flows. That is, the delivery fluid is supplied as a pilot source pressure to the primary sides of the control valves V via the supply fluid passage 31. Therefore, the plurality of control valves V can switch the delivery amount (output) of the hydraulic fluid supplied from the delivery fluid passage 30 and a delivery direction of the hydraulic fluid by changing a switching position. Thus, the plurality of control valves V control the hydraulic actuators AC.

As illustrated in FIG. 2, the control valves V include the dozer control valve V1 for controlling the dozer cylinder C1, the swing control valve V2 for controlling the swing cylinder C2, the first traveling control valve V3 for controlling the traveling motor ML of the left traveling device 3L, the second traveling control valve V4 for controlling the traveling motor MR of the right traveling device 3R, the boom control valve V5 for controlling the boom cylinder C3, the arm control valve V6 for controlling the arm cylinder C4, the bucket control valve V7 for controlling the bucket cylinder C5, the slew control valve V8 for controlling the slewing motor MT, and the SP control valve V9 for controlling the hydraulic actuator AC attached to the hydraulic attachment when the hydraulic attachment is attached as the working tool. Although FIG. 2 illustrates an example in which the control valves V include the SP control valve V9, the control valves V may not include the SP control valve V9.

Figure 3:
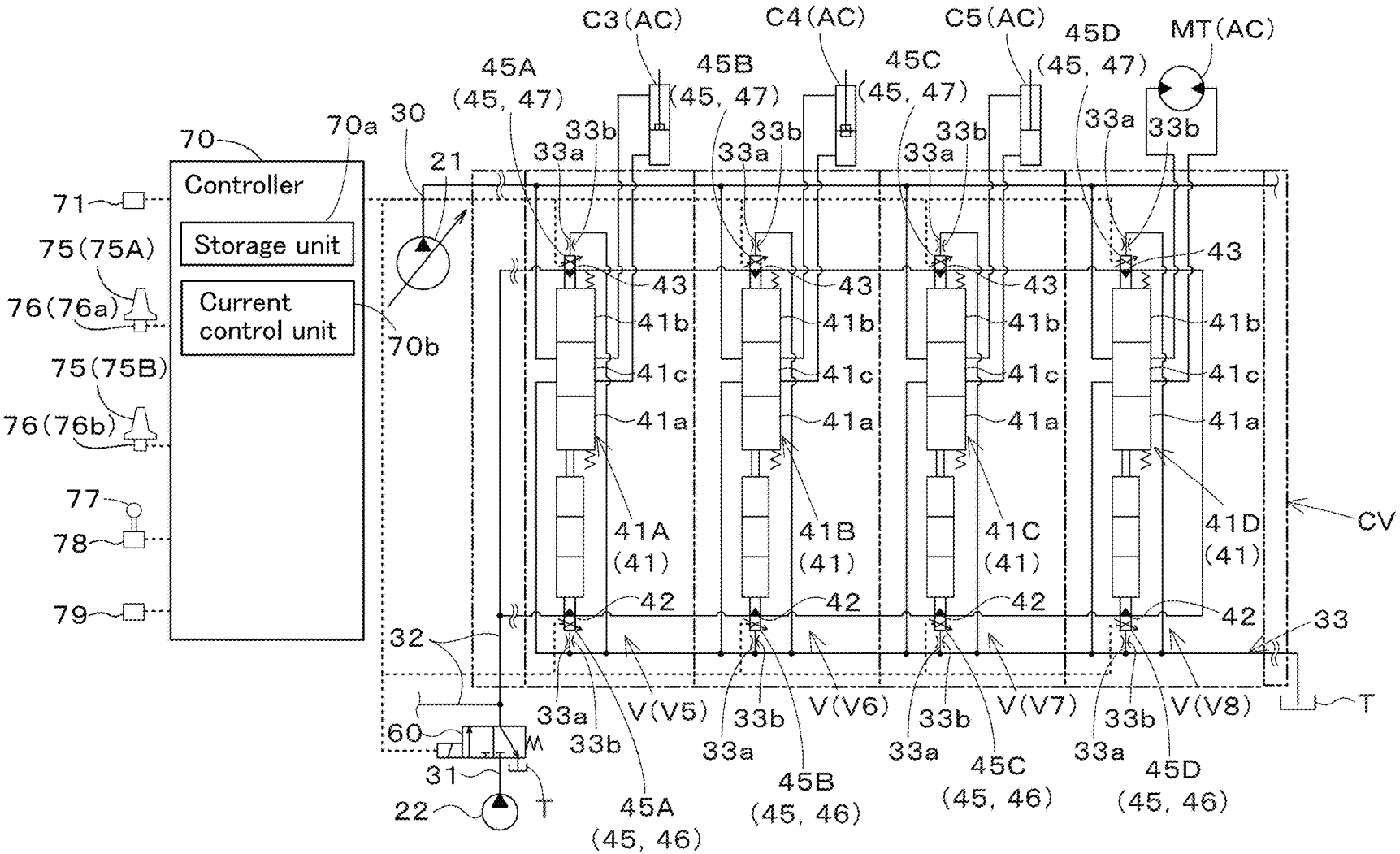
FIG. 3 is a hydraulic circuit diagram related to a boom control valve, an arm control valve, a bucket control valve, and a slew control valve in the first embodiment.

FIG. 3 illustrates a schematic configuration of a hydraulic circuit related to the boom control valve V5, the arm control valve V6, the bucket control valve V7, and the slew control valve V8 in the first embodiment. At least one of the plurality of control valves Vis an electromagnetic three-position switching valve in which the position of a spool is switched in accordance with a supplied current value I. Specifically, at least one of the plurality of control valves V includes a direction switching valve 41 and a solenoid proportional valve 45, and the solenoid proportional valve 45 changes an opening in accordance with the supplied current value I to change the pressure of the pilot fluid acting on a spool of the direction switching valve 41, thereby changing the position of the spool.

In the present embodiment, as illustrated in FIG. 3, the boom control valve V5, the arm control valve V6, the bucket control valve V7, and the slew control valve V8 are electromagnetic three-position switching valves in which the above-described solenoid proportional valves 45 are incorporated. That is, each of the boom control valve V5, the arm control valve V6, the bucket control valve V7, and the slew control valve V8 has the direction switching valve 41 and the solenoid proportional valve 45.

In the following description, the direction switching valve 41 of the boom control valve V5 is referred to as a first switching valve 41A, and the direction switching valve 41 of the arm control valve V6 is referred to as a second switching valve 41B. In addition, the direction switching valve 41 of the bucket control valve V7 is referred to as a third switching valve 41C, and the direction switching valve 41 of the slew control valve V8 is referred to as a fourth switching valve 41D.

In the following description, the solenoid proportional valve 45 of the boom control valve V5 is referred to as a first solenoid valve 45A, and the solenoid proportional valve 45 of the arm control valve V6 is referred to as a second solenoid valve 45B. In addition, the solenoid proportional valve 45 of the bucket control valve V7 is referred to as a third solenoid valve 45C, and the solenoid proportional valve 45 of the slew control valve V8 is referred to as a fourth solenoid valve 45D.

The direction switching valve 41 is a direct-acting spool type switching valve that controls the operation of the hydraulic actuator AC by changing the flow rate of the hydraulic fluid supplied to the hydraulic actuator AC, and can change the switching position by the hydraulic fluid supplied from the solenoid proportional valve 45. In the direction switching valve 41, the spool is moved in proportion to the flow rate of the hydraulic fluid supplied from the solenoid proportional valve 45, and the hydraulic fluid in an amount proportional to the amount of movement of the spool is supplied to the operation-target hydraulic actuator AC.

The direction switching valve 41 is switchable among a first position 41*a*, a second position 41*b*, and a neutral position 41*c*. The direction switching valve 41 is held in the neutral position 41*c* by biasing forces of a neutral spring on one side in the switching direction and a neutral spring on the other side opposite to the one side, and is switched from the neutral position 41*c* to the first position 41*a* or the second position 41*b* by the pressure of the hydraulic fluid output from the solenoid proportional valve 45.

The direction switching valve 41 has a first pressure receiver 42 on one side in the switching direction and a second pressure receiver 43 on the other side. Therefore, when the hydraulic fluid supplied from the solenoid proportional valve 45 acts on the first pressure receiver 42, the direction switching valve 41 is switched from the neutral position 41*c* to the first position 41*a*. In addition, when the hydraulic fluid supplied from the solenoid proportional valve 45 acts on the second pressure receiver 43, the direction switching valve 41 is switched from the neutral position 41*c* to the second position 41*b*. Thus, the direction switching valve 41 can switch the delivery amount (output)

of the hydraulic fluid supplied from the delivery fluid passage 30 and the delivery direction of the hydraulic fluid.

The solenoid proportional valve 45 controls the switching position of the direction switching valve 41 by a solenoid (not illustrated) being energized in accordance with the supplied current. Specifically, when a current is supplied to the solenoid proportional valve 45, the solenoid is energized to change the opening, thereby changing the flow rate of the hydraulic fluid acting on the pressure receivers 42 and 43. Note that the current supplied to the solenoid proportional valve 45 has a dither amplitude. In other words, the current supplied to the solenoid proportional valve 45 is a dither current to which a vibration component is applied. The solenoid slightly moves due to the dither amplitude, and the hydraulic fluid acting on the pressure receivers 42 and 43 of the direction switching valve 41 from the solenoid proportional valve 45 also pulsates.

As illustrated in FIG. 3, the solenoid proportional valve 45 has a first proportional valve 46 for supplying the hydraulic fluid to the first pressure receiver 42 of the direction switching valve 41, and a second proportional valve 47 for supplying the hydraulic fluid to the second pressure receiver 43 on the side opposite to the first pressure receiver 42 of the direction switching valve 41. The hydraulic fluid delivered from the second pump 22 is supplied to the first proportional valve 46 and the second proportional valve 47 via the supply fluid passage 31.

Specifically, the hydraulic system S of the working machine 1 includes a hydraulic fluid passage 32 connected to the supply fluid passage 31, and a drain fluid passage 33 connected to the hydraulic fluid tank T storing the hydraulic fluid. A first end of the hydraulic fluid passage 32 is connected to the supply fluid passage 31, and a second end thereof opposite to the first end is branched into a plurality of portions and connected to ports (primary ports) on the primary sides of the solenoid proportional valves 45 (the first proportional valves 46 and the second proportional valves 47). Therefore, the hydraulic fluid passage 32 can supply the hydraulic fluid flowing through the supply fluid passage 31 to each of the solenoid proportional valves 45 (the first proportional valves 46 and the second proportional valves 47). That is, the delivery fluid delivered from the second pump 22 is supplied to the solenoid proportional valves 45 via the supply fluid passage 31 and the hydraulic fluid passage 32.

In addition, as illustrated in FIG. 3, a first end of the drain fluid passage 33 is connected to the hydraulic fluid tank T, and a second end thereof opposite to the first end is branched into a plurality of portions and connected to the solenoid proportional valves 45 and the direction switching valves 41. Specifically, the second end of the drain fluid passage 33 is connected to fluid passages between delivery ports of the solenoid proportional valves 45 and the pressure receivers (the first pressure receivers 42 and the second pressure receivers 43) of the direction switching valves 41, and discharge ports (ports for discharging the return fluid from the hydraulic actuators AC) of the direction switching valves 41. In addition, throttles 33*b* are provided in portions (discharge fluid passages 33*a*) of the drain fluid passage 33 which merge between secondary-side ports (secondary ports) of the solenoid proportional valves 45 and the pressure receivers (the first pressure receivers 42 and the second pressure receivers 43) of the direction switching valves 41.

Therefore, the drain fluid passage 33 can discharge part of the hydraulic fluid supplied from the solenoid proportional valve 45 to the pressure receivers (the first pressure receiver 42 and the second pressure receiver 43) of the direction switching valve 41 and the hydraulic fluid discharged from the direction switching valve 41 to the hydraulic fluid tank T.

Thus, the solenoid proportional valve 45 can change the opening in accordance with the magnitude of the supplied current to supply the hydraulic fluid supplied from the hydraulic fluid passage 32 to the pressure receivers (the first pressure receiver 42 and the second pressure receiver 43) of the direction switching valve 41 and discharge the hydraulic fluid to the drain fluid passage 33.

In this embodiment, an electromagnetic three-position switching valve incorporating the solenoid proportional valve 45 and the direction switching valve 41 is illustrated, but the solenoid proportional valve 45 may be configured separately from the direction switching valve 41. In addition, the configuration is not limited to the configuration in which the operation of the direction switching valve 41 is switched by using the pilot hydraulic fluid, and a configuration in which the solenoid proportional valve 45 directly drives the spool of the direction switching valve 41 may be adopted. In addition, the plurality of control valves V may be, but not limited to, a two-position switching valve, a four-position switching valve, or the like other than the three-position switching valve.

As illustrated in FIG. 3, the hydraulic system S of the working machine 1 includes a controller 70. The controller 70 is a device including an electric/electronic circuit, a program stored in a CPU, an MPU, or the like, and the like. The controller 70 controls various devices included in the working machine 1. For example, the controller 70 can control the prime mover E1 and the rotational speed of the prime mover E1 (prime mover rotational speed). In addition, the controller 70 includes a storage unit 70*a*. The storage unit 70*a* is a non-volatile memory or the like, and stores various kinds of information and the like related to the control of the controller 70.

The solenoids of the solenoid proportional valves 45 are connected to the controller 70, and the solenoid proportional valves 45 change the opening in accordance with the magnitude of the current (current value I, command signal) supplied from the controller 70, and performs the switching operation of the respective direction switching valves 41 by the pilot pressure corresponding to the current value I. In addition, a first operation member 75 for operating the respective direction switching valves 41 is connected to the controller 70.

The first operation member (operation member) 75 is an operation actuator for the worker to operate the hydraulic actuators AC. The first operation member 75 includes a sensor 76 that detects an operation direction and an operation amount. The configuration of the sensor 76 is not limited to a particular configuration, and for example, a potentiometer or the like can be used. The sensor 76 is connected to the controller 70 and outputs the detected operation direction and operation amount as a detection signal. In the following description, the first operation member 75 may be simply referred to as an "operation member".

The controller 70 supplies a current of the current value I corresponding to the operation amount of the first operation member 75 to the solenoid of the operation-target solenoid proportional valve 45. Specifically, as illustrated in FIG. 3, the controller 70 includes a current control unit 70*b* that controls (defines) the current to be supplied to the solenoid proportional valve 45 (solenoid) in accordance with the operation direction and the operation amount of the first operation member 75.

The current control unit 70*b* includes electric/electronic components provided in the controller 70, a program incorporated in the storage unit 70*a*, and the like. The current control unit 70*b* defines a current (current value I) to be supplied to the solenoid proportional valve 45 (solenoid) based on the detection signal output from the sensor 76 to the controller 70 and a control map or a predetermined arithmetic expression stored in advance in the storage unit 70*a*. Thus, the controller 70 supplies the current defined by the current control unit 70*b* to the solenoid of the operation-target solenoid proportional valve 45. As described above, the dither amplitude exists in the current supplied by the controller 70 to the solenoid of the operation-target solenoid proportional valve 45.

In the present embodiment, the first operation member 75 includes a first operation actuator 75A and a second operation actuator 75B. The first operation actuator 75A can operate two operation targets provided in the working machine 1, for example, can operate the first switching valve 41A and the third switching valve 41C. In other words, the first operation actuator 75A can perform a swing operation of the boom 15 and a swing operation of the bucket 17. In addition, the first operation actuator 75A includes, as the sensor 76, a first sensor 76*a* that detects an operation direction and an operation amount of the first operation actuator 75A. Therefore, the current control unit 70*b* defines a current to be supplied to the first solenoid valve 45A and the third solenoid valve 45C based on a detection signal output from the first sensor 76*a*, and the controller 70 supplies the current to the first solenoid valve 45A and the third solenoid valve 45C.

For example, when the first operation actuator 75A is operated in the front-rear direction, the current control unit 70*b* defines the current to be supplied to the first solenoid valve 45A based on the detection signal output from the first sensor 76*a*, and the controller 70 supplies the current to the first solenoid valve 45A. On the other hand, when the first operation actuator 75A is operated in the machine-body widthwise direction, the current control unit 70*b* defines the current to be supplied to the third solenoid valve 45C based on the detection signal output from the first sensor 76*a*, and the controller 70 supplies the current to the third solenoid valve 45C. Thus, the controller 70 controls the first switching valve 41A and the third switching valve 41C based on the operation of the first operation actuator 75A. The second operation actuator 75B can operate two operation targets provided in the working machine 1, for example, can operate the second switching valve 41B and the fourth switching valve 41D. In other words, the second operation actuator 75B can perform a swing operation of the arm 16 and a slewing operation of the slewing motor MT. In addition, the second operation actuator 75B includes, as the sensor 76, a second sensor 76*b* that detects the operation direction and the operation amount of the second operation actuator 75B. Therefore, the current control unit 70*b* defines a current to be supplied to the second solenoid valve 45B and the fourth solenoid valve 45D based on a detection signal output from the second sensor 76*b*, and the controller 70 supplies the current to the second solenoid valve 45B and the fourth solenoid valve 45D.

For example, when the second operation actuator 75B is operated in the front-rear direction, the current control unit 70*b* defines the current to be supplied to the second solenoid valve 45B based on the detection signal output from the second sensor 76*b*, and the controller 70 supplies the current to the second solenoid valve 45B. On the other hand, when the second operation actuator 75B is operated in the machine-body widthwise direction, the current control unit 70*b* defines the current to be supplied to the fourth solenoid valve 45D based on the detection signal output from the second sensor 76*b*, and the controller 70 supplies the current to the fourth solenoid valve 45D. Thus, the controller 70 controls the second switching valve 41B and the fourth switching valve 41D based on the operation of the second operation actuator 75B.

Note that the first operation actuator 75A and the second operation actuator 75B are constituted by, for example, operation levers gripped and operated by the worker seated on the operator's seat 6.

In the present embodiment, as illustrated in FIG. 3, the boom control valve V5, the arm control valve V6, the bucket control valve V7, and the slew control valve V8 are electromagnetic three-position switching valves in which the above-described solenoid proportional valves 45 are incorporated. On the other hand, the dozer control valve V1, the swing control valve V2, the first traveling control valve V3, the second traveling control valve V4, and the SP control valve V9 are constituted by pilot-operation switching valves that are pilot-operated by an operation device (not illustrated). The operation device includes a pilot valve that outputs a pilot pressure (pilot fluid) to the control valves V (V1 to V4 and V9), and a second operation member that operates the pilot valve. The second operation member is constituted by, for example, an operation lever, a pedal, or the like disposed around the operator's seat 6.

In the hydraulic system S of the working machine 1, the plurality of control valves V only need to include at least one control valve V incorporating the solenoid proportional valve 45, and the control valve V incorporating the solenoid proportional valve 45 is not limited to any of the boom control valve V5, the arm control valve V6, the bucket control valve V7, and the slew control valve V8. For example, the control valve V incorporating the solenoid proportional valve 45 may be any of the dozer control valve V1, the swing control valve V2, the first traveling control valve V3, the second traveling control valve V4, and the SP control valve V9, and the combination thereof is not limited.

As illustrated in FIG. 3, the hydraulic system S of the working machine 1 includes a permission operation actuator 77 and an unloading valve 60. The permission operation actuator 77 is an operation actuator capable of performing a switching operation between a permission operation for permitting the driving of the hydraulic actuators AC and a non-permission operation for not permitting the driving. Specifically, the permission operation actuator 77 is the lever lock 77 capable of performing the permission operation and the non-permission operation by being subjected to a swing operation.

As illustrated in FIG. 1, the lever lock 77 is provided on a side of the operator's seat 6 at a position corresponding to a passage (entrance/exit path) 5 through which the worker gets on and off. The lever lock 77 is supported to be swingable between a lowered state (lowered position) 77*a* in a first direction and a raised state (raised position) 77*b* in a second direction opposite to the first direction. In detail, the lever lock 77 can perform the permission operation by performing the swing operation to the lowered position 77*a*, and when the lever lock 77 is subjected to the swing operation to the lowered position 77*a*, the lever lock 77 closes the entrance/exit path 5 to the operator's seat 6 to disable the entrance/exit.

On the other hand, when the lever lock 77 can perform the non-permission operation by performing the swing operation to the raised position 77*b*, and when the lever lock 77 is subjected to the swing operation to the raised position 77*b*, the entrance/exit path 5 is opened to enable the entrance/exit.

In addition, as illustrated in FIG. 3, the lever lock 77 has a permission switch 78. The permission switch 78 is a switch that can be switched between two positions and detects the switching operation (the permission operation and the non-permission operation) of the lever lock 77. In addition, the permission switch 78 is connected to the controller 70, and outputs a detection signal indicating the detection of the switching operation to the controller 70.

The unloading valve 60 is a valve that permits or does not permit the driving of the hydraulic actuators AC in accordance with an operation of the permission operation actuator (lever lock) 77. The unloading valve 60 is provided between the supply fluid passage 31 and the hydraulic fluid passage 32. Specifically, as illustrated in FIG. 2, the unloading valve 60 has a primary-side port (primary port) 60*a* to which the supply fluid passage 31 is connected, a secondary-side port (secondary port) 60*b* to which the hydraulic fluid passage 32 is connected, and a discharge port 60*c* to which the hydraulic fluid tank T is connected.

The unloading valve 60 is a two-position switching valve that can be switched between a supply position (loading position) 61 for permitting the driving of the hydraulic actuators AC and a suppression position (unloading position) 62 for suppressing the driving of the hydraulic actuators AC. When the lever lock 77 is subjected to the permission operation, the unloading valve 60 is switched to the supply position 61 for supplying the hydraulic fluid in the supply fluid passage 31 to the hydraulic fluid passage 32. In the supply position 61, the unloading valve 60 communicates the supply fluid passage 31 with the start end of the hydraulic fluid passage 32.

On the other hand, when the lever lock 77 is subjected to the non-permission operation, the unloading valve 60 is switched to the suppression position 62 for suppressing the supply of the hydraulic fluid to the hydraulic fluid passage 32, that is, for stopping the supply of the hydraulic fluid in the supply fluid passage 31 to the hydraulic fluid passage 32.

In the suppression position 62, the unloading valve 60 blocks communication between the supply fluid passage 31 and the start end of the hydraulic fluid passage 32, and communicates the start end of the supply fluid passage 31 with the discharge port 60*c*.

The unloading valve 60 is biased by a spring in a direction in which the unloading valve 60 is switched to the suppression position 62. The unloading valve 60 is switched to the suppression position 62 when a solenoid is deenergized, and is switched to the supply position 61 when the solenoid is energized. Switching control of the unloading valve 60 is performed by the controller 70.

The controller 70 controls a current to be supplied to the solenoid of the unloading valve 60 based on the detection signal output from the permission switch 78, in other words, the switching operation of the lever lock 77. Specifically, when the permission switch 78 detects the permission operation of the lever lock 77 (when the lever lock 77 is in the lowered position 77*a*), the controller 70 supplies a current to the solenoid of the unloading valve 60, energizes the solenoid, and switches the unloading valve 60 to the supply position 61.

On the other hand, when the permission switch 78 detects the non-permission operation of the lever lock 77 (when the lever lock 77 is in the raised position 77*b*), the controller 70 stops the supply of the current to the solenoid of the unloading valve 60, deenergizes the solenoid, and switches the unloading valve 60 to the suppression position 62.

Thus, when the lever lock 77 is subjected to the switching operation (the permission operation) to the lowered position 77*a*, the unloading valve 60 is switched to the supply position 61, and the hydraulic fluid (pilot fluid) delivered by the second pump 22 is supplied to the primary-side ports of the solenoid proportional valves 45 and the pilot-operation switching valves via the supply fluid passage 31, the unloading valve 60, and the hydraulic fluid passage 32, and the operation of the hydraulic actuators AC (MR, ML, MT, and C1 to C5) is enabled.

On the other hand, when the lever lock 77 is subjected to the switching operation (the non-permission operation) to the raised position 77*b*, the unloading valve 60 is switched to the suppression position 62, the hydraulic fluid is not supplied to the primary-side ports of the solenoid proportional valves 45 and the pilot-operation switching valves, and the operation of hydraulic actuators AC (MR, ML, MT, and C1 to C5) is disabled.

In the hydraulic system S of the working machine 1, when the permission operation actuator 77 is subjected to the non-permission operation and the temperature of the hydraulic fluid is lower than a predetermined temperature (threshold value), the controller 70 supplies, to the solenoid proportional valves 45, a current (first standby current) of a first current value Ia defined in a range in which the switching position of the direction switching valves 41 is not switched.

Note that the first current value Ia is preferably defined as a current value I that is as large as possible within a range in which the switching position of the direction switching valves 41 is not switched.

When the permission operation actuator 77 is subjected to the non-permission operation and the temperature of the hydraulic fluid is higher than or equal to the predetermined temperature (threshold value), the controller 70 continuously or intermittently supplies a current (second standby current) of a second current value Ib smaller than the first current value Ia to each solenoid proportional valve 45. Thus, the response speed of the solenoid proportional valve 45 can be improved.

When the permission operation actuator 77 is subjected to the permission operation and the temperature of the hydraulic fluid is lower than the predetermined temperature (threshold value), the controller 70 continuously or intermittently supplies the current (first standby current) of the first current value Ia or the current (second standby current) of the second current value Ib to the solenoid proportional valves 45 not operated by the operation member (first operation member) 75. In the present embodiment, when the permission operation actuator 77 is subjected to the permission operation and the temperature of the hydraulic fluid is lower than the predetermined temperature (threshold value), the controller 70 supplies the first standby current to the solenoid proportional valves 45 not operated by the first operation member 75.

When the permission operation actuator 77 is subjected to the permission operation and the temperature of the hydraulic fluid is higher than or equal to the predetermined temperature (threshold value), the controller 70 continuously or intermittently supplies the current (second standby current) of the second current value Ib to the solenoid proportional valves 45 not operated by the operation member (first operation member) 75.

In the following description, the first standby current and the second standby current may be simply referred to as a "standby current". In addition, the current control unit 70*b* determines whether the condition for causing the standby current to flow through the solenoid proportional valves 45 is satisfied. When the current control unit 70*b* determines that the condition is satisfied, the current control unit 70*b* defines the current to be supplied to the solenoid proportional valves 45 (solenoids).

The current control unit 70*b* determines whether the temperature of the hydraulic fluid is lower than the predetermined temperature (threshold value) based on the temperature of the hydraulic fluid detected by a detector 79 included in the hydraulic system S of the working machine 1. The detector 79 is a device that detects the temperature (fluid temperature) of hydraulic fluid such as a pilot fluid in the hydraulic system S of the working machine 1. The detector 79 is constituted by a fluid temperature sensor, and is provided in a port to which the hydraulic fluid tank T is connected of the ports of the second pump 22.

As illustrated in FIG. 3, the detector 79 is connected to the controller 70, and outputs the detected fluid temperature to the controller 70 as a detection signal. The threshold value is defined in advance and stored in the storage unit 70*a*. The controller 70 determines whether the fluid temperature acquired from the detector 79 is lower than the threshold value stored in the storage unit 70*a*. The threshold value is defined as a value within a range of 25° C. to 35° C., for example. Note that the threshold value is not limited to the range of 25° C. to 35° C. In addition, the threshold value may be defined as a fixed value, or may be changeable using an operation actuator (not illustrated) provided in the working machine 1, a portable terminal communicably connected to the controller 70, or the like.

In addition, the current control unit 70*b* determines whether the prime mover E1 is being driven based on a signal for starting the prime mover E1 output to the controller 70. Specifically, the current control unit 70*b* determines whether the prime mover E1 is being driven based on a signal output from an ignition switch 71 to the controller 70.

The ignition switch 71 is a switch for starting the prime mover E1. The ignition switch 71 is connected to the controller 70, and the controller 70 starts and stops the prime mover E1 based on signals (a start signal and a stop signal) output from the ignition switch 71. Specifically, when the ignition switch 71 is turned on, the ignition switch 71 outputs a start signal to the controller 70, and the controller 70 starts the prime mover E1 through a predetermined process. On the other hand, when the ignition switch 71 is turned off, the ignition switch 71 outputs a stop signal to the controller 70, and the controller 70 stops the driving of the prime mover E1. Note that the ignition switch 71 is not limited to a mechanical type (key cylinder type) operated by inserting an engine key into a key cylinder, and may be a smart entry type, which permits or prohibits starting of the prime mover by wireless communication.

Therefore, the current control unit 70*b* determines that the prime mover E1 is being driven when the start signal is output from the ignition switch 71 to the controller 70, and determines that the prime mover E1 is stopped when the stop signal is output.

Hereinafter, the standby current (the first standby current and the second standby current) defined by the current control unit 70*b* will be described in detail. When the temperature of the hydraulic fluid is lower than the predetermined temperature (threshold value), the current control unit 70*b* defines the first standby current as the standby current to be supplied to the solenoid proportional valves 45. Specifically, the current control unit 70*b* defines the first standby current for both of the first proportional valves 46 and the second proportional valves 47. Specifically, when the temperature of the hydraulic fluid is lower than the predetermined temperature (threshold value) and the permission operation actuator 77 is subjected to the non-permission operation (when the unloading valve 60 is in the suppression position 62), the current control unit 70*b* defines the first standby current for both of the first proportional valves 46 and the second proportional valves 47 of the respective solenoid proportional valves 45. In addition, when the temperature of the hydraulic fluid is lower than the predetermined temperature (threshold value) and the permission operation actuator 77 is subjected to the permission operation (when the unloading valve 60 is in the supply position 61), the current control unit 70*b* defines the first standby current for the solenoid proportional valves 45 not operated by the first operation member 75 among the solenoid proportional valves 45 included in the hydraulic system S of the working machine 1.

On the other hand, when the temperature of the hydraulic fluid is higher than or equal to the predetermined temperature (threshold value), the current control unit 70*b* defines the second standby current, which is a current having the second current value Ib lower than the first current value Ia of the first standby current, as the standby current to be supplied to the solenoid proportional valves 45. Specifically, when the temperature of the hydraulic fluid is higher than or equal to the predetermined temperature (threshold value) and the permission operation actuator 77 is subjected to the non-permission operation (when the unloading valve 60 is in the suppression position 62), the current control unit 70*b* defines the second standby current for both of the first proportional valves 46 and the second proportional valves 47 of the respective solenoid proportional valves 45. In addition, when the temperature of the hydraulic fluid is higher than or equal to the predetermined temperature (threshold value) and the permission operation actuator 77 is subjected to the permission operation (when the unloading valve 60 is in the supply position 61), the current control unit 70*b* defines the second standby current for the solenoid proportional valves 45 not operated by the first operation member 75 among the solenoid proportional valves 45 included in the hydraulic system S of the working machine 1.

The magnitudes (the first current value Ia and the second current value Ib) of the standby current for the first solenoid valve 45A to the fourth solenoid valve 45D may be the same or different for the respective solenoid valves.

When the permission operation actuator 77 is subjected to the permission operation (when the unloading valve 60 is in the supply position 61), the current control unit 70*b* specifies the first proportional valves 46 and the second proportional valves 47, which are not operated, based on a detection signal output from the sensor 76. The current control unit 70*b* defines the standby current for the specified first proportional valves 46 and second proportional valves 47. That is, in the present embodiment, for example, when both of the first operation actuator 75A and the second operation actuator 75B are not operated, the standby current is defined for all of the first solenoid valve 45A, the second solenoid valve 45B, the third solenoid valve 45C, and the fourth solenoid valve 45D, which are not operated by the first operation actuator 75A and the second operation actuator 75B.

In addition, for example, when the first operation actuator 75A is operated only in the front-rear direction and the second operation actuator 75B is not operated, the current control unit 70*b* defines the current to be supplied to the first solenoid valve 45A operated by the first operation actuator 75A in accordance with the operation amount of the first operation actuator 75A based on a detection signal output from the first sensor 76*a*, and defines the standby current for the second solenoid valve 45B, the third solenoid valve 45C, and the fourth solenoid valve 45D, which are not operated by the first operation actuator 75A and the second operation actuator 75B.

Figure 4:
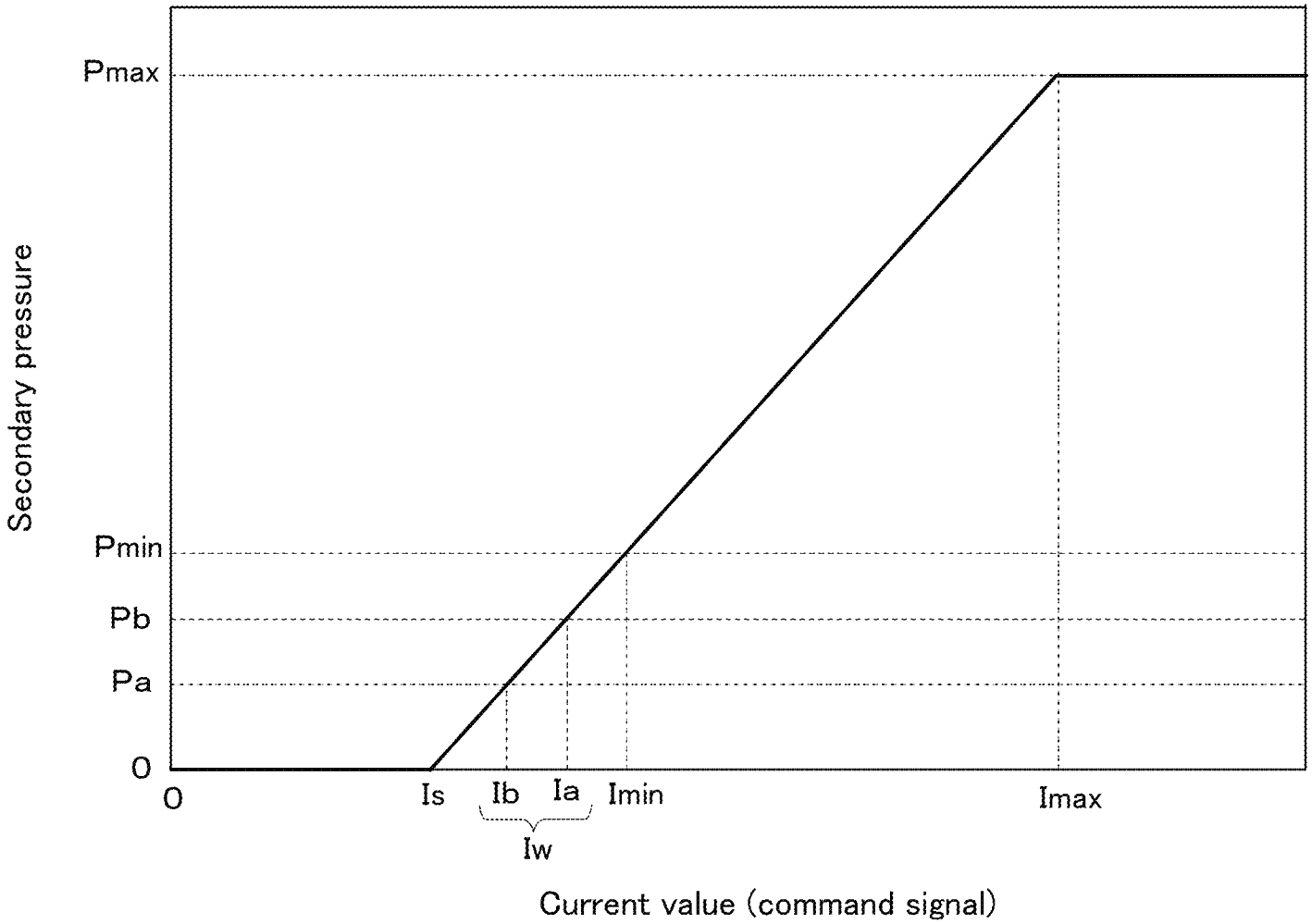
FIG. 4 is a diagram illustrating a relationship between a magnitude (current value) of a current supplied to a solenoid proportional valve and a secondary pressure supplied from the solenoid proportional valve to a direction switching valve.

Hereinafter, the magnitude Ia of the first standby current defined by the current control unit 70*b* will be described in detail with reference to FIG. 4. FIG. 4 is a diagram illustrating a relationship between a magnitude (current value) I of a current supplied to the solenoid proportional valve 45 and a secondary pressure supplied from the solenoid proportional valve 45 to the direction switching valve 41. FIG. 4 illustrates a case where the unloading valve 60 is switched to the supply position 61, and the hydraulic fluid delivered by the second pump 22 is supplied to the solenoid proportional valve 45 as a primary pressure. In the graph of FIG. 4, the horizontal axis indicates the magnitude (current value, command signal) I of the current supplied to the solenoid proportional valve 45 by the controller 70, and the vertical axis indicates the secondary pressure of the hydraulic fluid supplied to the pressure receivers (the first pressure receiver 42 and the second pressure receiver 43) of the direction switching valve 41 when the solenoid is energized to change the opening by the current supplied to the solenoid proportional valve 45.

As illustrated in FIG. 4, when the current supplied to the solenoid proportional valve 45 is within a predetermined range ($Is \leq I < Imax$), the secondary pressure output from the solenoid proportional valve 45 increases as the current increases. When the current supplied to the solenoid proportional valve 45 is less than Is ($I < Is$), the secondary pressure output from the solenoid proportional valve 45 is zero and is constant. When the current supplied to the solenoid proportional valve 45 is greater than or equal to Imax ($I \geq Imax$), the secondary pressure output from the solenoid proportional valve 45 is Pmax and is constant.

In addition, in FIG. 4, the minimum value (activation pressure) of the pressure of the hydraulic fluid at which the switching position of the direction switching valve 41 changes is indicated by Pmin. When the solenoid proportional valve 45 outputs the activation pressure Pmin, the current value (activation current value) of the current supplied to the solenoid proportional valve 45 is Imin. That is, when the current value I of the current supplied to the solenoid proportional valve 45 is less than the activation current value Imin, the pressure of the pilot hydraulic fluid acting on the direction switching valve 41 is less than the activation pressure Pmin, and the switching position of the direction switching valve 41 is not switched.

The current control unit 70*b* defines a current of the first current value Ia smaller than Imin as the first standby current. For example, when Imin is 1.0 A, the current control unit 70*b* defines the first current value Ia to be less than 1.0 A. Note that the first standby current is a dither current obtained by adding a vibration component to the first current value Ia.

As illustrated in FIG. 4, the first current value Ia and the second current value Ib are current values I smaller than the activation current value Imin ($Ia < Imin$, $Ib < Imin$). In addition, the second current value Ib is a current value I smaller than the first current value Ia ($Ib < Ia$). Note that the second standby current is a dither current obtained by adding a vibration component to the second current value Ib.

Therefore, when the prime mover E1 is driven, the temperature of the hydraulic fluid is lower than the predetermined temperature (threshold value), the permission operation actuator 77 is subjected to the non-permission operation, and the unloading valve 60 is in the suppression position 62, the current control unit 70*b* defines the first standby current (the current of the first current value Ia) for the first proportional valve 46 and the second proportional valve 47. Thus, the controller 70 supplies the first standby current to the first proportional valve 46 and the second proportional valve 47, and solenoids of the first proportional valve 46 and the second proportional valve 47 supplied with the first standby current vibrate with the dither amplitude. In addition, the first proportional valve 46 and the second proportional valve 47 supplied with the first standby current supply the hydraulic fluid at a first secondary pressure Pa to the pressure receivers (the first pressure receiver 42 and the second pressure receiver 43) of the direction switching valve 41. Since the first secondary pressure Pa is smaller than the activation pressure Pmin of the direction switching valve 41, the switching position of the direction switching valve 41 is not changed, and the hydraulic fluid flowing from the first proportional valve 46 and the second proportional valve 47 to the pressure receivers 42 and 43 of the direction switching valve 41 is discharged through the discharge fluid passage 33*a* and the throttle 33*b*. Therefore, the solenoid proportional valve 45 and the hydraulic fluid therein can be warmed up by the vibration of the solenoids and the circulation of the hydraulic fluid.

On the other hand, when the prime mover E1 is driven and the temperature of the hydraulic fluid is higher than or equal to the predetermined temperature (threshold value), the current control unit 70*b* defines the second standby current (current of the second current value Ib) for the first proportional valve 46 and the second proportional valve 47 which are not operated. Thus, the controller 70 supplies the second standby current to the first proportional valve 46 and the second proportional valve 47 which are not operated, and the solenoids of the first proportional valve 46 and the second proportional valve 47 to which the second standby current is supplied vibrate. Therefore, the solenoid proportional valve 45 and the hydraulic fluid therein can be warmed up.

According to the above configuration, when the temperature of the hydraulic fluid is lower than the predetermined temperature (threshold value), the permission operation actuator 77 is subjected to the non-permission operation, and the unloading valve 60 is in the suppression position 62, the controller 70 supplies the first standby current to the solenoid of the solenoid proportional valve 45. Thus, since the solenoid can vibrate by the first standby current, the solenoid proportional valve 45 and the hydraulic fluid therein can be warmed up.

On the other hand, when the temperature is relatively high, the controller 70 supplies the second standby current of a current value lower than that of the first standby current to the first proportional valve 46 and the second proportional valve 47. Thus, it is possible to reduce the load while preventing or reducing the response delay of the solenoid proportional valve 45.

In the above-described embodiment, when the permission operation actuator 77 is subjected to the non-permission operation and the temperature of the hydraulic fluid is higher than or equal to the predetermined temperature (threshold value), the controller 70 supplies the second standby current to each solenoid proportional valve 45. However, the current may not be supplied to each solenoid proportional valve 45. Thus, the response speed of the solenoid proportional valve 45 can be improved at a low temperature, and the current is suppressed to reduce the power consumption and to prevent or reduce the heat generation of the controller 70 except at a low temperature. Alternatively, the standby current may be supplied to the first proportional valve 46 and the second proportional valve 47 which are not operated, regardless of the temperature of the hydraulic fluid.

In the above-described embodiment, the current control unit 70*b* defines the constant current of the first current value Ia or the second current value Ib in accordance with the operation (the permission operation or the non-permission operation) of the permission operation actuator 77. The magnitude of the current may be at least less than the current value (the activation current value) Imin corresponding to the activation pressure Pmin, and may be reduced, for example, as the temperature of the hydraulic fluid increases, in other words, a current value Iw of the standby current may be increased as the temperature of the hydraulic fluid decreases. In addition, the magnitude Iw of the first current value Ia and the second current value Ib may be changeable by using an operation actuator (not illustrated) provided in the working machine 1, a portable terminal communicably connected to the controller 70, or the like.

Figure 5:
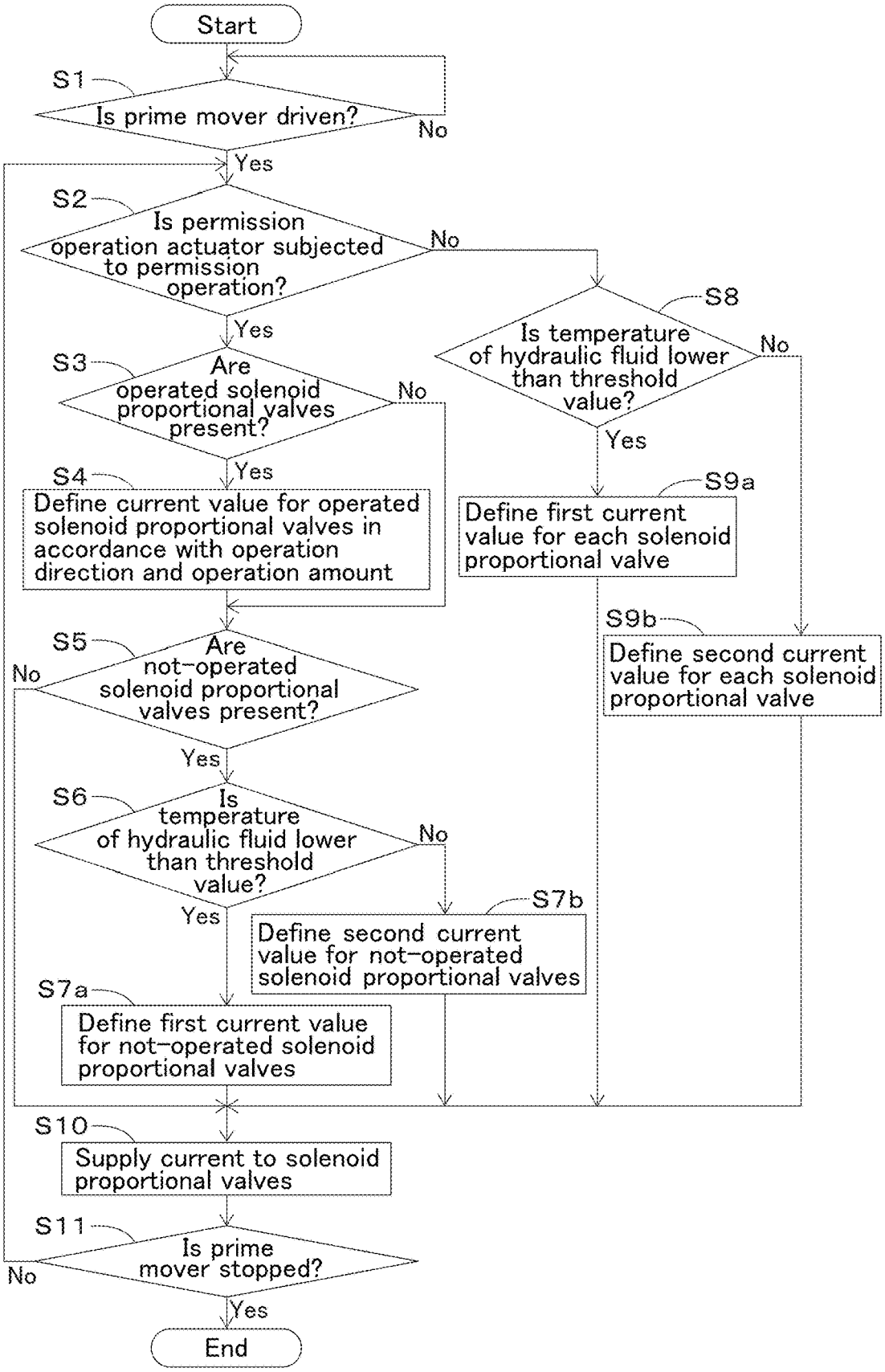
FIG. 5 is a flowchart illustrating the definition of a predetermined current by a current control unit and the supply of the predetermined current by the controller.

Hereinafter, a flow of defining the current value I by the current control unit 70*b* will be described with reference to a flowchart illustrated in FIG. 5.

The current control unit 70*b* monitors whether the prime mover E1 is being driven based on a signal (start signal) output from the ignition switch 71 to the controller 70 (S1).

If it is determined that the prime mover E1 is being driven (S1, Yes), the current control unit 70*b* determines whether the permission operation actuator 77 is subjected to a permission operation based on a detection signal output from the permission switch 78 to the controller 70 (S2).

If it is determined in S2 that the permission operation is performed (S2, Yes), the current control unit 70*b* determines whether the solenoid proportional valves 45 operated by the first operation member 75 are present based on a detection signal output from the sensor 76 to the controller 70 (S3).

If it is determined in S3 that the operated solenoid proportional valves 45 are present (S3, Yes), the current control unit 70*b* defines the current value I to be supplied to the operated solenoid proportional valves 45 in accordance with the operation direction and the operation amount of the first operation member 75 (S4). The current control unit 70*b* defines the current value I to be supplied to the solenoid proportional valves 45 based on, for example, the operation direction and the operation amount of the first operation member 75 and a control map or a predetermined arithmetic expression stored in the storage unit 70*a* in advance.

If it is determined in S3 that the operated solenoid proportional valves 45 are not present (S3, No), or after the current value I to be supplied to the operated solenoid proportional valves 45 is defined in S4, the current control unit 70*b* determines whether the solenoid proportional valves 45 not operated by the first operation member 75 are present based on a detection signal output from the sensor 76 to the controller 70 (S5).

If it is determined in S5 that the not-operated solenoid proportional valves 45 are present (S5, Yes), the current control unit 70*b* determines whether the temperature of the hydraulic fluid is lower than a threshold value (predetermined temperature) based on a detection signal output from the detector 79 (S6).

If it is determined in S6 that the temperature of the hydraulic fluid is lower than the threshold value (S6, Yes), the current control unit 70*b* defines the current value I to be supplied to the not-operated solenoid proportional valves 45 as the first current value Ia (S7*a*). On the other hand, if it is determined in S6 that the temperature of the hydraulic fluid is not lower than the threshold value (S6, No), the current control unit 70*b* defines the current value I to be supplied to the not-operated solenoid proportional valves 45 as the second current value Ib (S7*b*). Note that the processing S6 may be skipped, and the current control unit 70*b* may define the current value I to be supplied to the not-operated solenoid proportional valves 45 as the second current value Ib regardless of the temperature of the hydraulic fluid.

If it is determined in S2 that the permission operation is not performed (S2, No), the current control unit 70*b* determines whether the temperature of the hydraulic fluid is lower than the threshold value (predetermined temperature) based on a detection signal output from the detector 79 (S8).

If it is determined in S8 that the temperature of the hydraulic fluid is lower than the threshold value (S8, Yes), the current control unit 70*b* defines the current value I to be supplied to each of the solenoid proportional valves 45 as the first current value Ia (S9*a*). On the other hand, if it is determined in S8 that the temperature of the hydraulic fluid is not lower than the threshold value (S8, No), the current control unit 70*b* defines the current value I to be supplied to each of the solenoid proportional valves 45 as the second current value Ib (S9*b*). Note that the processing S8 may be skipped, and the standby current of the first current value Ia may be supplied to each of the solenoid proportional valves 45 if it is determined in S2 that the permission operation is not performed.

If it is determined in S5 that the not-operated solenoid proportional valves 45 are not present (S5, No), after the current value I to be supplied to the not-operated solenoid proportional valves 45 is defined as the first current value Ia in S7*a* or S9*a*, or after the current value I to be supplied to the solenoid proportional valves 45 is defined as the second current value Ib in S7*b* or S9*b*, the controller 70 supplies a current to each of the solenoid proportional valves 45 based on the current value I defined by the current control unit 70*b* (S10).

After the current is supplied to each of the solenoid proportional valves 45 in S10, the current control unit 70*b* determines whether the prime mover E1 is stopped based on a signal (start signal) output from the ignition switch 71 to the controller 70 (S11). If it is determined in S11 that the prime mover E1 is stopped, the process ends, and if it is determined in S11 that the prime mover E1 is not stopped, the process in and after S2 is repeated.

In a modified example in which the controller 70 does not supply a current to each of the solenoid proportional valves 45 if the permission operation actuator 77 is subjected to the non-permission operation and the temperature of the hydraulic fluid is higher than or equal to the predetermined temperature (threshold value), the controller 70 skips S9*b* and proceeds to S11 without defining the current value I.

The hydraulic system S of the working machine 1 described above includes: the hydraulic actuator AC to be driven by a hydraulic fluid; the direction switching valve 41 to change a flow rate of the hydraulic fluid to be supplied to the hydraulic actuator AC to control an operation of the hydraulic actuator AC; the solenoid proportional valve 45 to control a switching position of the direction switching valve 41 by a solenoid being energized in accordance with a supplied current; the controller 70 to control a current to be supplied to the solenoid proportional valve 45; the operation member (first operation member) 75 for a worker to operate the hydraulic actuator AC; and the permission operation actuator 77 capable of performing a switching operation between a permission operation for permitting driving of the hydraulic actuator AC and a non-permission operation for not permitting the driving. When the permission operation actuator 77 is subjected to the non-permission operation and a temperature of the hydraulic fluid is lower than a predetermined temperature, the controller 70 supplies, to the solenoid proportional valve 45, a first standby current of the first current value Ia defined in a range in which the switching position of the direction switching valve 41 is not switched.

According to the above-described configuration, when the permission operation actuator 77 is subjected to the non-permission operation and the temperature of the hydraulic fluid is lower than the predetermined temperature, the controller 70 supplies the first standby current to the solenoid proportional valve 45. Accordingly, even at a low temperature, it is possible to prevent or reduce a decrease in response speed when the solenoid proportional valve 45 is driven thereafter.

In addition, when the temperature of the hydraulic fluid is higher than or equal to the predetermined temperature, the controller 70 supplies a second standby current of the second current value Ib lower than the first current value Ia to the solenoid proportional valve 45 corresponding to the hydraulic actuator AC not operated by the first operation member 75. Accordingly, when the temperature of the hydraulic fluid is relatively high, the response speed can be improved while preventing or reducing the load and the power consumption of the controller 70.

In addition, when the permission operation actuator 77 is subjected to the permission operation and the temperature of the hydraulic fluid is lower than the predetermined temperature, the controller 70 supplies the first standby current or a second standby current of a second current value Ib lower than the first current value Ia to the solenoid proportional valve 45 corresponding to the hydraulic actuator AC not operated by the first operation member 75. Accordingly, even when the permission operation actuator 77 is subjected to the permission operation, the standby current is supplied to the solenoid proportional valve 45 corresponding to the hydraulic actuator AC not operated by the first operation member 75 at a low temperature, and thus, a decrease in response speed can be prevented or reduced.

In addition, when the permission operation actuator 77 is subjected to the permission operation and the temperature of the hydraulic fluid is lower than the predetermined temperature, the controller 70 may cause the first standby current to flow through the solenoid proportional valve 45 corresponding to the hydraulic actuator AC not operated by the first operation member 75, and, when the permission operation actuator 77 is subjected to the permission operation and the temperature of the hydraulic fluid is higher than or equal to the predetermined temperature, the controller 70 may cause the second standby current to flow through the solenoid proportional valve 45 corresponding to the hydraulic actuator AC not operated by the first operation member 75. Accordingly, a decrease in response speed at a low temperature can be prevented or reduced, and the load and power consumption of the controller 70 can be prevented or reduced when the temperature of the hydraulic fluid is relatively high.

In addition, when the permission operation actuator 77 is subjected to the non-permission operation and the temperature of the hydraulic fluid is higher than or equal to the predetermined temperature, the controller 70 may not supply a current to the solenoid proportional valve 45. Accordingly, the load and power consumption of the controller 70 can be prevented or reduced when the temperature of the hydraulic fluid is relatively high.

In addition, the controller 70 supplies a dither current obtained by adding a vibration component to the first current value Ia to the solenoid proportional valve 45 as the first standby current. Accordingly, the sliding resistance can be reduced by micro-vibrating the solenoid, and the response speed can be improved.

In addition, the working machine 1 includes the hydraulic system S of the working machine 1 described above. Accordingly, the working machine 1 having the above-described excellent effects can be implemented.

Second Embodiment

Figure 6:
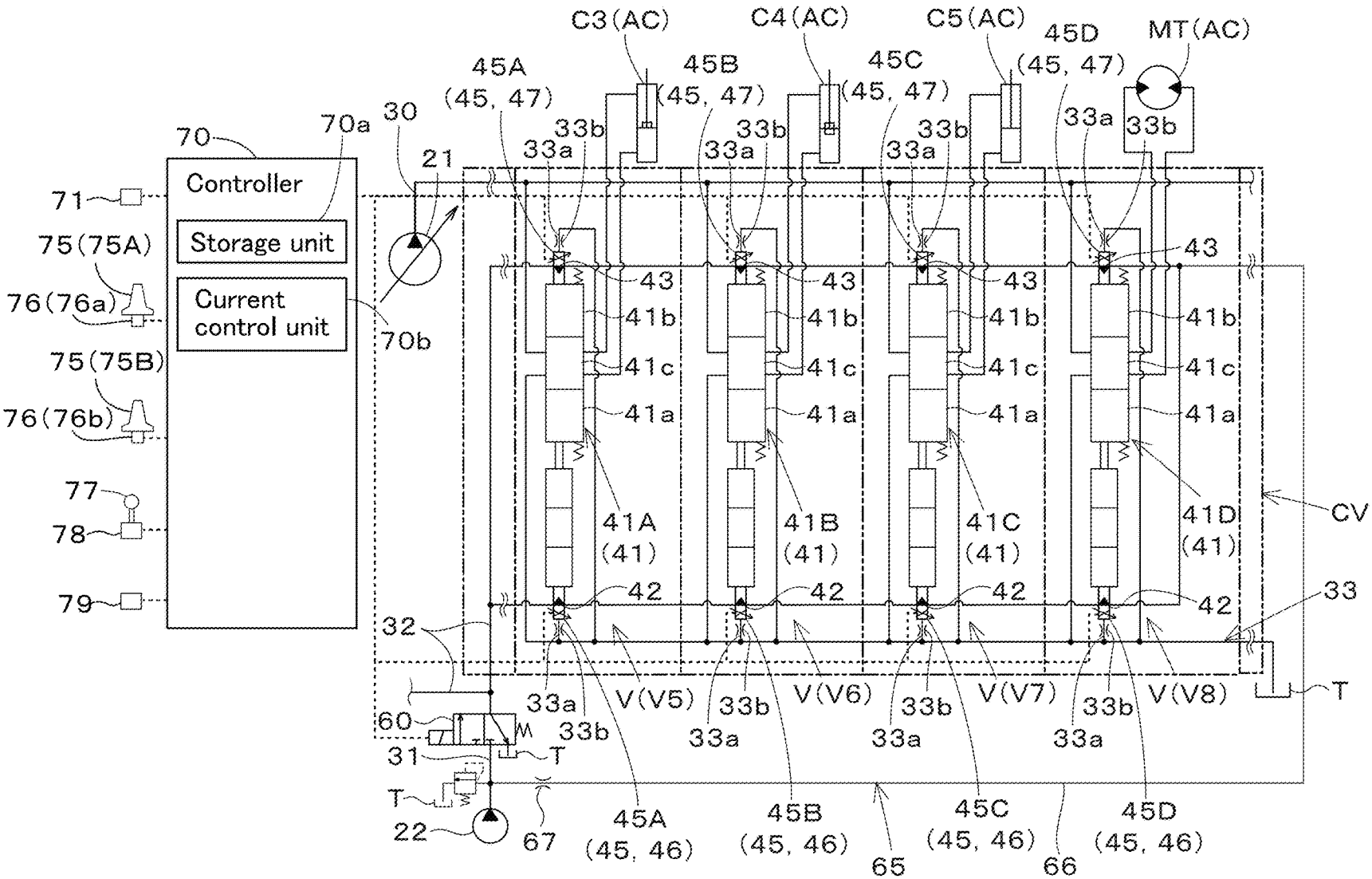
FIG. 6 is a hydraulic circuit diagram related to the boom control valve, the arm control valve, the bucket control valve, and the slew control valve in a second embodiment.

FIG. 6 illustrates another embodiment (second embodiment) of the hydraulic system S of the working machine 1.

Hereinafter, the hydraulic system S of the working machine 1 of the second embodiment will be described focusing on configurations different from those of the above-described embodiment (first embodiment), and configurations common to those of the first embodiment will be denoted by the same reference numerals, and a detailed description thereof will be omitted. Unlike in the first embodiment, the hydraulic system S of the working machine 1 of the second embodiment includes a warm-up fluid passage 65 for warming up the hydraulic fluid in the hydraulic fluid passage 32 when the permission operation actuator 77 is subjected to the non-permission operation and the unloading valve 60 is in the suppression position 62. The warm-up fluid passage 65 is a fluid passage that circulates the hydraulic fluid delivered by the second pump 22 to the hydraulic fluid tank T via the hydraulic fluid passage 32 when the unloading valve 60 is in the suppression position 62, and the hydraulic fluid is discharged to the hydraulic fluid tank T via the hydraulic fluid passage 32 and the secondary port 60*b* and the discharge port 60*c* of the unloading valve 60. That is, the discharge port 60*c* discharges the hydraulic fluid that passes through the warm-up fluid passage 65 and flows into the hydraulic fluid passage 32 when the unloading valve 60 is in the suppression position 62. Therefore, when the unloading valve 60 is in the suppression position 62, the hydraulic fluid circulates through the second pump 22, the warm-up fluid passage 65, the hydraulic fluid passage 32, the unloading valve 60, and the hydraulic fluid tank T.

Specifically, for example, the warm-up fluid passage 65 is a fluid passage that connects the supply fluid passage 31 and the hydraulic fluid passage 32 in parallel to the unloading valve 60. In addition, the warm-up fluid passage 65 has a connecting fluid passage 66 for connecting the midway portion of the supply fluid passage 31 and the terminal end of the hydraulic fluid passage 32, and a throttle 67 provided in the connecting fluid passage 66. The throttle 67 restricts the flow rate of the hydraulic fluid flowing from the second pump 22 to the hydraulic fluid passage 32 via the connecting fluid passage 66 so that the operation-target hydraulic actuators AC (MT, ML, MR, and C1 to C5) are not activated even when the solenoid proportional valves 45 and pilot valves are operated in a state where the unloading valve 60 is switched to the suppression position 62. In other words, the flow rate of the hydraulic fluid flowing to the hydraulic fluid passage 32 is restricted so that a pressure for operating the direction switching valves 41 is not applied to the secondary ports of the solenoid proportional valves 45, and a pressure for operating the pilot-operation switching valves is not applied to the secondary ports of the pilot valves.

Thus, when the unloading valve 60 is set to the suppression position 62 by the non-permission operation of the permission operation actuator 77, the hydraulic fluid delivered from the second pump 22 is supplied to the terminal end of the hydraulic fluid passage 32 from the supply fluid passage 31 through the warm-up fluid passage 65. In addition, the hydraulic fluid flowing into the terminal end of the hydraulic fluid passage 32 flows to the start end of the hydraulic fluid passage 32, and is discharged from the start end to the hydraulic fluid tank T via the unloading valve 60. As a result, the hydraulic fluid sucked up from the hydraulic fluid tank T by the second pump 22 is supplied to the primary ports of the solenoid proportional valves 45 and the primary-side ports of the pilot valves.

Hereinafter, in the hydraulic system S of the working machine 1 of the second embodiment, a case where the prime mover E1 is driven, the temperature of the hydraulic fluid is lower than the predetermined temperature (threshold value), the permission operation actuator 77 is subjected to the non-permission operation, and the unloading valve 60 is in the suppression position 62 will be described. In such a case, the controller 70 supplies the first standby current to the first proportional valve 46 and the second proportional valve 47, and the hydraulic fluid of a second secondary pressure Pb is supplied to the pressure receivers (the first pressure receiver 42 and the second pressure receiver 43) of the direction switching valve 41. Here, since the second secondary pressure Pb is smaller than the activation pressure Pmin of the direction switching valve 41, the switching position of the direction switching valve 41 is not changed, and the hydraulic fluid flowing from the first proportional valve 46 and the second proportional valve 47 to the pressure receivers 42 and 43 of the direction switching valve 41 is discharged through the discharge fluid passage 33*a* and the throttle 33*b*. That is, in the hydraulic system S of the hydraulic fluid in the second embodiment, even when the permission operation actuator 77 is subjected to the non-permission operation, the hydraulic fluid in the solenoid proportional valve 45 can be consumed (circulated) in addition to the vibration of the solenoid, and the warm-up of the solenoid proportional valve 45 and the hydraulic fluid therein can be further improved.

Note that the warm-up fluid passage 65 illustrated in FIG. 6 is merely an example, and the configuration thereof is not limited to the above-described configuration as long as the warm-up fluid passage 65 can supply the hydraulic fluid delivered by the second pump 22 to the hydraulic fluid passage 32 when the unloading valve 60 is in the suppression position 62. For example, when the unloading valve 60 is in the suppression position 62, the unloading valve 60 may block the communication between the hydraulic fluid passage 32 and the hydraulic fluid tank T, and the hydraulic fluid supplied from the warm-up fluid passage 65 to the hydraulic fluid passage 32 may be circulated to the hydraulic fluid tank T via the solenoid proportional valve 45 and the drain fluid passage 33.

The hydraulic system S of the working machine 1 described above includes the hydraulic fluid tank T to store the hydraulic fluid; the hydraulic pump 22 to suck and deliver the hydraulic fluid in the hydraulic fluid tank T; the supply fluid passage 31 connected to the hydraulic pump 22; the hydraulic fluid passage 32 connected to the supply fluid passage 31 and the solenoid proportional valve 45 to supply the hydraulic fluid from the supply fluid passage 31 to the solenoid proportional valve 45; and the warm-up fluid passage 65 to circulate the hydraulic fluid delivered by the hydraulic pump 22 to the hydraulic fluid tank T via the hydraulic fluid passage 32 when the permission operation actuator 77 is subjected to the non-permission operation. According to the above configuration, the hydraulic fluid passage 32 can be warmed up when the non-permission operation is performed on the permission operation actuator 77, and a decrease in response speed at a low temperature can be prevented or reduced more effectively.

In addition, the hydraulic system S of the working machine 1 includes the unloading valve 60 to be switched to the supply position 61 in which the hydraulic fluid in the supply fluid passage 31 is supplied to the hydraulic fluid passage 32 when the permission operation actuator 77 is subjected to the permission operation, and to be switched to the suppression position 62 in which supply of the hydraulic fluid to the hydraulic fluid passage 32 is suppressed when the permission operation actuator 77 is subjected to the non-permission operation, in which the warm-up fluid passage 65 connects the supply fluid passage 31 and the hydraulic fluid passage 32 in parallel to the unloading valve 60. According to the above-described configuration, when the permission operation actuator 77 performs the non-permission operation, the hydraulic fluid can be circulated from the supply fluid passage 31 to the hydraulic fluid passage 32 while bypassing the unloading valve 60. Accordingly, a decrease in response speed at a low temperature can be prevented or reduced more effectively.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A hydraulic system of a working machine, comprising:

a hydraulic actuator to be driven by a hydraulic fluid;

a direction switching valve to change a flow rate of the hydraulic fluid to be supplied to the hydraulic actuator to control an operation of the hydraulic actuator;

a solenoid proportional valve to control a switching position of the direction switching valve by a solenoid being energized in accordance with a supplied current;

a controller to control a current to be supplied to the solenoid proportional valve;

an operation member for a worker to operate the hydraulic actuator; and a permission operation actuator capable of performing a switching operation between a permission operation for permitting driving of the hydraulic actuator and a non-permission operation for not permitting the driving, wherein when the permission operation actuator is subjected to the non-permission operation and a temperature of the hydraulic fluid is lower than a predetermined temperature, the controller supplies, to the solenoid proportional valve, a first standby current of a first current value defined in a range in which the switching position of the direction switching valve is not switched;

wherein, when the permission operation actuator is subjected to the non-permission operation and the temperature of the hydraulic fluid is higher than or equal to the predetermined temperature, the controller does not supply a current to the solenoid proportional valve.

2. The hydraulic system of a working machine according to claim 1, wherein, when the temperature of the hydraulic fluid is higher than or equal to the predetermined temperature, the controller supplies a second standby current of a second current value lower than the first current value to the solenoid proportional valve corresponding to the hydraulic actuator not operated by the operation member.

3. The hydraulic system of a working machine according to claim 1, wherein, when the permission operation actuator is subjected to the permission operation and the temperature of the hydraulic fluid is lower than the predetermined temperature, the controller supplies the first standby current or a second standby current of a second current value lower than the first current value to the solenoid proportional valve corresponding to the hydraulic actuator not operated by the operation member.

4. The hydraulic system of a working machine according to claim 3, wherein when the permission operation actuator is subjected to the permission operation and the temperature of the hydraulic fluid is lower than the predetermined temperature, the controller causes the first standby current to flow through the solenoid proportional valve corresponding to the hydraulic actuator not operated by the operation member, and when the permission operation actuator is subjected to the permission operation and the temperature of the hydraulic fluid is higher than or equal to the predetermined temperature, the controller causes the second standby current to flow through the solenoid proportional valve corresponding to the hydraulic actuator not operated by the operation member.

5. The hydraulic system of a working machine according to claim 1, wherein the controller supplies a dither current obtained by adding a vibration component to the first current value to the solenoid proportional valve as the first standby current.

6. The hydraulic system of a working machine according to claim 1, wherein the permission operation actuator is a lever lock capable of performing the permission operation and the non-permission operation by being subjected to a swing operation.

7. A working machine comprising the hydraulic system of the working machine according to claim 1.

8. A hydraulic system of a working machine, comprising:

a hydraulic actuator to be driven by a hydraulic fluid;

a direction switching valve to change a flow rate of the hydraulic fluid to be supplied to the hydraulic actuator to control an operation of the hydraulic actuator;

a solenoid proportional valve to control a switching position of the direction switching valve by a solenoid being energized in accordance with a supplied current;

a controller to control a current to be supplied to the solenoid proportional valve;

an operation member for a worker to operate the hydraulic actuator;

a permission operation actuator capable of performing a switching operation between a permission operation for permitting driving of the hydraulic actuator and a non-permission operation for not permitting the driving;

a hydraulic fluid tank to store the hydraulic fluid;

a hydraulic pump to suck and deliver the hydraulic fluid in the hydraulic fluid tank;

a supply fluid passage connected to the hydraulic pump; and a hydraulic fluid passage connected to the supply fluid passage and the solenoid proportional valve to supply the hydraulic fluid from the supply fluid passage to the solenoid proportional valve, wherein:

when the permission operation actuator is subjected to the non-permission operation and a temperature of the hydraulic fluid is lower than a predetermined temperature, the controller supplies, to the solenoid proportional valve, a first standby current of a first current value defined in a range in which the switching position of the direction switching valve is not switched, and the hydraulic system further comprises a warm-up fluid passage to circulate the hydraulic fluid delivered by the hydraulic pump to the hydraulic fluid tank via the hydraulic fluid passage when the permission operation actuator is subjected to the non-permission operation.

9. The hydraulic system of a working machine according to claim 8, comprising an unloading valve to be switched to a supply position in which the hydraulic fluid in the supply fluid passage is supplied to the hydraulic fluid passage when the permission operation actuator is subjected to the permission operation, and to be switched to a suppression position in which supply of the hydraulic fluid to the hydraulic fluid passage is suppressed when the permission operation actuator is subjected to the non-permission operation, wherein the warm-up fluid passage connects the supply fluid passage and the hydraulic fluid passage in parallel to the unloading valve.

10. The hydraulic system of a working machine according to claim 8, wherein, when the temperature of the hydraulic fluid is higher than or equal to the predetermined temperature, the controller supplies a second standby current of a second current value lower than the first current value to the solenoid proportional valve corresponding to the hydraulic actuator not operated by the operation member.

11. The hydraulic system of a working machine according to claim 8, wherein, when the permission operation actuator is subjected to the permission operation and the temperature of the hydraulic fluid is lower than the predetermined temperature, the controller supplies the first standby current or a second standby current of a second current value lower than the first current value to the solenoid proportional valve corresponding to the hydraulic actuator not operated by the operation member.

12. The hydraulic system of a working machine according to claim 11, wherein when the permission operation actuator is subjected to the permission operation and the temperature of the hydraulic fluid is lower than the predetermined temperature, the controller causes the first standby current to flow through the solenoid proportional valve corresponding to the hydraulic actuator not operated by the operation member, and when the permission operation actuator is subjected to the permission operation and the temperature of the hydraulic fluid is higher than or equal to the predetermined temperature, the controller causes the second standby current to flow through the solenoid proportional valve corresponding to the hydraulic actuator not operated by the operation member.

13. The hydraulic system of a working machine according to claim 8, wherein the controller supplies a dither current obtained by adding a vibration component to the first current value to the solenoid proportional valve as the first standby current.

14. The hydraulic system of a working machine according to claim 8, wherein the permission operation actuator is a lever lock capable of performing the permission operation and the non-permission operation by being subjected to a swing operation.

15. A working machine comprising the hydraulic system of the working machine according to claim 8.

* * * * *